US007003819B2

(12) United States Patent
Weigand

(10) Patent No.: US 7,003,819 B2
(45) Date of Patent: Feb. 28, 2006

(54) PATIENT-POSITIONING DEVICE

(76) Inventor: Nancy E. Weigand, 5931 Freitag NW., Canton, OH (US) 44718

( * ) Notice: Subject to any disclaimer, the term of this patent is extended or adjusted under 35 U.S.C. 154(b) by 0 days.

(21) Appl. No.: 10/286,091

(22) Filed: Nov. 1, 2002

(65) Prior Publication Data

US 2003/0110559 A1 Jun. 19, 2003

Related U.S. Application Data

(60) Provisional application No. 60/336,125, filed on Nov. 2, 2001.

(51) Int. Cl.
*A61G 7/14* (2006.01)

(52) U.S. Cl. ..... 5/81.1 HS

(58) Field of Classification Search ..... 5/81.1 R, 5/88.1, 81.1 HS
See application file for complete search history.

(56) References Cited

U.S. PATENT DOCUMENTS

| | | | | |
|---|---|---|---|---|
| 1,085,879 A | | 2/1914 | Skeffington | |
| 2,665,432 A | * | 1/1954 | Butler | 5/88.1 |
| 2,827,642 A | | 3/1958 | Huff | |
| 3,108,290 A | | 10/1963 | Partridge | |
| 3,383,717 A | | 5/1968 | Underwood | |
| 3,562,824 A | | 2/1971 | White | |
| 3,829,914 A | | 8/1974 | Treat | |
| 4,502,169 A | * | 3/1985 | Persson | 5/88.1 |
| 4,627,119 A | * | 12/1986 | Hachey et al. | 5/85.1 |
| 4,747,170 A | * | 5/1988 | Knouse | 5/81.1 HS |
| 5,280,657 A | | 1/1994 | Stagg | |
| 5,608,929 A | | 3/1997 | Crane | |
| 6,065,162 A | * | 5/2000 | Behr | 5/81.1 R |
| 6,282,734 B1 | * | 9/2001 | Holberg | 5/81.1 HS |
| 6,289,533 B1 | * | 9/2001 | Hodgetts | 5/81.1 R |
| 2002/0083521 A1 | * | 7/2002 | Sverdlik et al. | 5/81.1 R |
| 2003/0213064 A1 | * | 11/2003 | Johnson | 5/86.1 |

* cited by examiner

*Primary Examiner*—Michael Safavi
(74) *Attorney, Agent, or Firm*—Brouse McDowell; John M. Skeriotis

(57) ABSTRACT

This invention is a device for translatably positioning a patient along a bed. The device has a motor connected to a series of pulleys. A corresponding series of straps are attached at one end to a respective pulley and at the other end to a bed sheet. As the pulleys are rotated by operation of the motor, each strap is wound around its respective pulley thereby causing the associated sheet to be drawn in the general direction of the pulleys. The device may be operated by the patient or a caregiver and the device contains a safety mechanism that prevents the pulleys from pulling the associated bed sheet completely into the device. In one embodiment of the invention, the components of the device are received onto a portable, adjustable frame that permits the device to be transported to a number of different beds and used with beds of differing sizes.

3 Claims, 5 Drawing Sheets

PATIENT-POSITIONING DEVICE

This Application claims priority of U.S. Provisional Application, Ser. No. 60/336,125 filed on Nov. 2, 2001, titled MOVE ME.

BACKGROUND OF THE INVENTION

A. Field of Invention

This invention pertains to the art, methods and apparatuses of patient positioning devices.

B. Description of the Related Art

The invention of this application is related to a patient positioning device that is useful for translating a bed-ridden patient that has slipped toward the end of the bed back to the first end of the bed, nearer the headboard, for example. Many times a patient that is confined to a bed may be propped up by pillows or, where the bed is motorized, as are many hospital beds, by elevating the first portion of the bed. The benefits to the patient of being elevated or propped up in this manner are numerous—giving rise to better digestion, breathing and enabling the patient to better interact with visitors and caregivers.

Often, however, a patient that has been propped up may begin to slide down toward the end of the bed. This results in the patient being hunched down and tends to arrest the benefits associated with being elevated. Indeed, the slumped position may exacerbate the patient's illness and generally make the patient uncomfortable. Furthermore, the patient may slide inexorably far toward the end of the bed, resulting in the need to reposition the patient back toward the head of the bed. There are a number of means available for repositioning a patient. The patient may try to reposition him or herself or one or more caregivers may assist the patient by physically grabbing hold of the patient and maneuvering the patient back toward the first end of the bed. These methods require significant physical strength and can result in injury to the patient or the caregivers.

A number of mechanical devices have been created to assist in positioning a patient on a bed. The basic elements of these devices are typically the same, namely a sheet with a plurality of straps connected to one end. The patient is placed on the sheet. When the patient slips toward the end of the bed, the patient can be moved toward the first end of the bed by pulling on the straps connected to the sheet, thereby translating the sheet and the patient in the direction of pull. Some inventions still rely on brute physical strength to pull the straps.

Considering the prior art, a patient positioning device is needed which is powered by a non-human source but easily controlled by either the patient or a caregiver. A device is also needed that can be readily adapted to fit a variety of beds, both flat beds and mechanized beds. Also a device is needed that can be quickly moved from bed to bed and from one size of a bed to a bed of a different size.

SUMMARY OF THE INVENTION

According to one aspect of the present invention, a new and improved patient positioning device is provided One aspect of this invention is that the device may be used with a standard flat bed. There is no requirement that the bed be adjustable or motorized in order for the device to operate.

Another aspect of this invention is that the device does not require significant physical effort on the part of the caregiver, nurse, or patient to operate or position the patient.

Another aspect of this invention is that the device may be portable and, therefore, transportable to different beds, for example, in a hospital or convalescent home.

Another aspect of this invention is that the device may be adjustable and, therefore, a single device may be usable with different types of beds.

This invention is a device for translatably positioning a patient along a bed. The device is comprised of a motor connected to a series of pulleys. A corresponding series of straps are attached at one end to a respective pulley and at the other end to a bed sheet. As the pulleys are rotated by operation of the motor, each strap is wound around its respective pulley thereby causing the associated sheet to be drawn in the general direction of the pulleys. The device may be operated by the patient or a caregiver and the device contains a safety mechanism that prevents the pulleys from pulling the associated bed sheet completely into the device. In one embodiment of the invention, the components of the device are received onto a portable, adjustable frame that permits the device to be transported to a number of different beds and used with beds of differing sizes.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
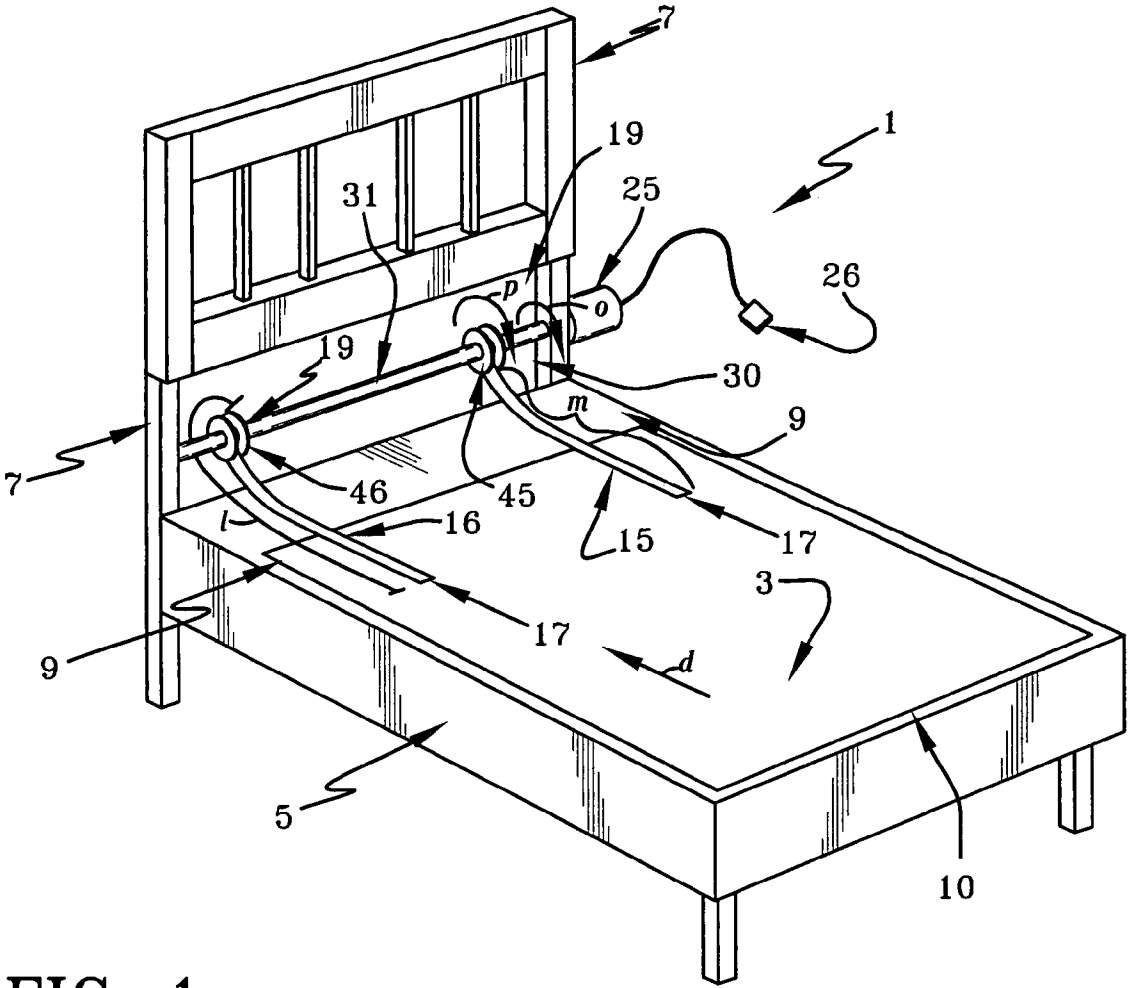
FIG. 1 is a plain view of patient positioning device with an associated bed.

Referring now to the drawings wherein the showings are for purposes of illustrating a preferred embodiment of the invention only and not for purposes of limiting the same, FIG. 1 shows a patient positioning device, generally shown at 1, having at least a first and second strap members 15, 16. Each of the at least a first and second strap members 15, 16 has a first end 17 and a second end 19. In the preferred embodiment, the device 1 may have two strap members 15, 16, coupled to an associated bed sheet 3, as discussed below; however it should be noted that there may be three or more strap members 15, 16 or any number of strap members 15, 16 selected with sound engineering judgment. The device 1 is used with an associated bed 5 having an associated bed frame 7 and an associated bed sheet 3. The associated bed sheet 3 has a first end 9 and a second end 10. The associated bed sheet 3 may be a standard, readily available top sheet; however, it is also contemplated that the associated bed sheet 3 may be any piece of material, such as plastic, fabric or rubber, or any material selected with sound engineering judgment. It is noted that the novelty of the device 1 is not dependant on the type or dimensions of the associated bed 5 or bed frame 7. The device 1 may be used with flat beds, motorized beds or hospital beds of varying sizes.

With continuing reference to FIG. 1, the first end 17 of each of the at least a first and second strap members 15, 16 may each be operatively coupled to the first end 9 of the associated bed sheet 3 so that as the strap members 15, 16 are drawn around pulleys 45, 46 (discussed in a following paragraph), the associated bed sheet 3 bearing an associated patient will also be drawn in a first direction d toward the pulleys 45, 46. In this way, the first end 17 of each of the strap members 15, 16 may be fixedly attached to the associated bed sheet 3 by use of an adhesive, or by sewing or use of other mechanical fasteners or by any means selected with sound engineering judgment. In the preferred embodiment, the first end 17 of each of the strap members 15, 16 may be removably attached to the associated bed sheet 3 with Velcro; however, it is contemplated that the first end 17 of each of the strap members 15, 16 could be removably attached to the associated bed sheet 3 using mechanical fasteners such as buttons, clips, buckles, pins, or by using any other means selected with sound engineering judgment. The strap members 15, 16 may three feet long. However, it is contemplated that the strap members 15, 16 may be any length l selected with sound engineering judgment. The strap members 15, 16 may be made out of fabric, rubber, metal, plastic or any other material selected with sound engineering judgment.

With continued reference to FIG. 1, the device 1 also includes a prime mover 25. In the preferred embodiment, the prime mover 25 is an electric motor. However, the prime mover 25 may be any mechanism that is selected with sound engineering judgment. In this manner, the prime mover 25 may have at least a first output 30. In one embodiment, the first output 30 may include a shaft 31, having a characteristic torque imposed thereon by the prime mover 25. It is also contemplated that the output 30 of the prime mover 25 may be sufficient to translate the strap members 15, 16 and associated patient as discussed in a later paragraph.

With continued reference to FIG. 1, the device 1 may also include first and second pulleys 45, 46. The first and second pulleys 45, 46 may be operatively coupled to the first output 30. This means that when the first output 30 rotates in a first output direction o, the first and second pulleys 45, 46 rotate in a first pulley direction p. The rotation of the first output 30 and the first and second pulleys 45, 46 may be in the same direction. It is also contemplated that the rotation of the first output 30 and the first and second pulleys 45, 46 may be in opposite directions. At this point it is noted that in the preferred embodiment, there are two pulleys 45, 46 located, as are the two strap members 15, 16, equidistant from a centerline of the associated bed frame 7 and adjacent the first end 9 of the associated bed sheet 3. However, as the number and location of the strap members 15, 16 may vary with sound engineering judgment, so also, the number and location of the pulleys 45, 46 may also very as selected with sound engineering judgment. The location of the pulleys 45, 46 in the preferred embodiment, places one of the pulleys 45, 46 on each side of the associated bed sheet 3 so that as the associated bed sheet 3 is drawn toward the pulleys 45, 46, the associated bed sheet 3 will be drawn substantially evenly toward the pulleys 45, 46.

With continued reference to FIG. 1, the first and second pulleys 45, 46 may be disc-shaped or tube-shaped or any shape that is selected with sound engineering judgment. As previously noted, the first output 30 of the prime mover 25 may include a shaft 31. In this embodiment, the first and second pulleys 45, 46 may be fixedly coupled to the shaft 31 included as part of the first output 30 by welding or by mechanical fastening or by process of manufacture wherein the first and second pulleys 45, 46 are integrally manufactured as a single part with the shaft 31 or by any means selected with sound engineering judgment. It is also contemplated that the first and second pulleys 45, 46 may be removably coupled to the shaft 31. In this way, the first and second pulleys 45, 46 may be selectively positioned along the length of the shaft 31. The first and second pulleys 45, 46 may be removably attached to the shaft 31 by use of mechanical fasteners, such as a retractable pin, or thumbscrew or by magnetic means or by such other means as is selected with sound engineering judgment. It should be noted however, that the first and second pulleys 45, 46 may be operatively coupled to the first output 30 as with a gearing mechanism, magnetic mechanism, or by any means selected with sound engineering judgment.

Figure 1A:
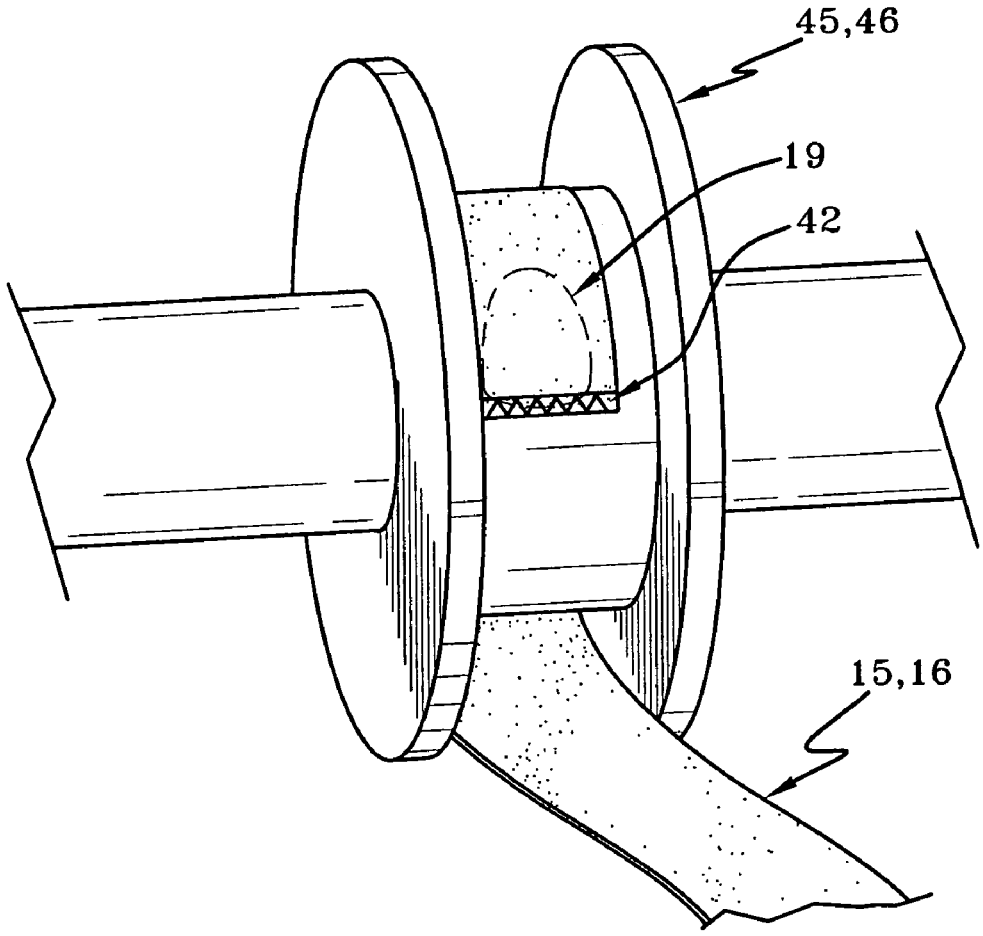
FIG. 1A is a close-up view of a connection between a pulley and a strap member.

With reference to FIGS. 1 and 1*a*, the second end 19 of each of the first and second strap members 15, 16 may be attached to a respective one of the first and second pulleys 45, 46. In the preferred embodiment, the second end 19 of the each of the strap members 15, 16 may be removably attached to a respective one of the first and second pulleys 45, 46 as with Velcro, mechanical fasteners or by winding the second end 19 of each of the first and second strap members 15, 16 around itself on a respective one of the first and second pulleys 45, 46 so that the second end 19 is held by friction. This latter embodiment is demonstrated in FIG. 1*a*, which additionally shows the second end 19 of each of the first and second strap members 15, 16 firstly being held in a slot 42 in each of the first and second pulleys 45, 46. However, it should be noted that the second end 19 of the each of the strap members 15, 16 may be removably attached to a respective one of the first and second pulleys 45, 46 by any means selected with sound engineering judgment. It is also contemplated that the second end 19 of each of the strap members 15, 16 may also be fixedly attached to a respective one of the first and second pulleys 45, 46, as with adhesives, mechanical fasteners or any other means selected with sound engineering judgment. When the first and second pulleys 45, 46 rotate in response to the rotation of the first output 30, each of the strap members 15, 16 which are respectively attached to a respective one of the first and second pulleys 45, 46 is wound around the respective pulley 45, 46. In this way, the first and second strap members 15, 16 are each windably communicated with a respective one of the first and second pulleys 45, 46. As each of the first and second strap members 15, 16 is wound onto a respective one of the first and second pulleys 45, 46, the portion m of the length l of each of the first and second strap members 15, 16 that remains unwound decreases. As the portion m decreases, the first end 17 of each of the first and second strap members 15, 16 moves in a direction toward the first and second pulleys 45, 46, drawing the first end 9 of the associated bed sheet 3 toward the first and second pulleys 45, 46.

With ongoing reference to FIG. 1, the device 1 may also include a safety means 26. The safety means 26 operates to control the winding of the first and second strap members 15, 16 around the respective first and second pulleys 45, 46. In this way, the safety means 26 may be operatively communicated to the prime mover 25. The safety means 26 may operate to restrict the angular translation of the first output 30. The safety means 26 may operate to stop the angular translation of the first output 30. The safety means 26 may also operate to disengage the ability of the first output 30 to angularly translate, as, for example, by cutting off power to the prime mover 25 or by disrupting any contact between the prime mover 25 and the first output 30. The safety means 26 may operate with variable control to slow down or reverse the angular translation of the first output 30. The safety means 26 may operate to disengage the first and second pulleys 45, 46. The safety means 26 may operate in any other way that is selected with sound engineering judgment. It is also noted that the safety means 26 may be connected to the device 1 through a cord; however, it is contemplated that the safety means 26 may be integrated with one or more components of the device 1, as for example, an override switch located on or in the prime mover 25. Additionally, the safety means 26 may be remote from the device 1, as, for example, a remote control device. Any number of safety means 26 for controlling the translation of the associated bed sheet toward the first and second pulleys 45, 46 may be selected with sound engineering judgment.

With ongoing reference to FIG. 1, in one embodiment of the device 1, the assembly comprised of the aforementioned prime mover 25, first output 30, first and second pulleys 45, 46, safety means 26 and first and second strap members 15, 16 may be received onto the associated bed frame 25 of the associated bed 5.

Figure 2:
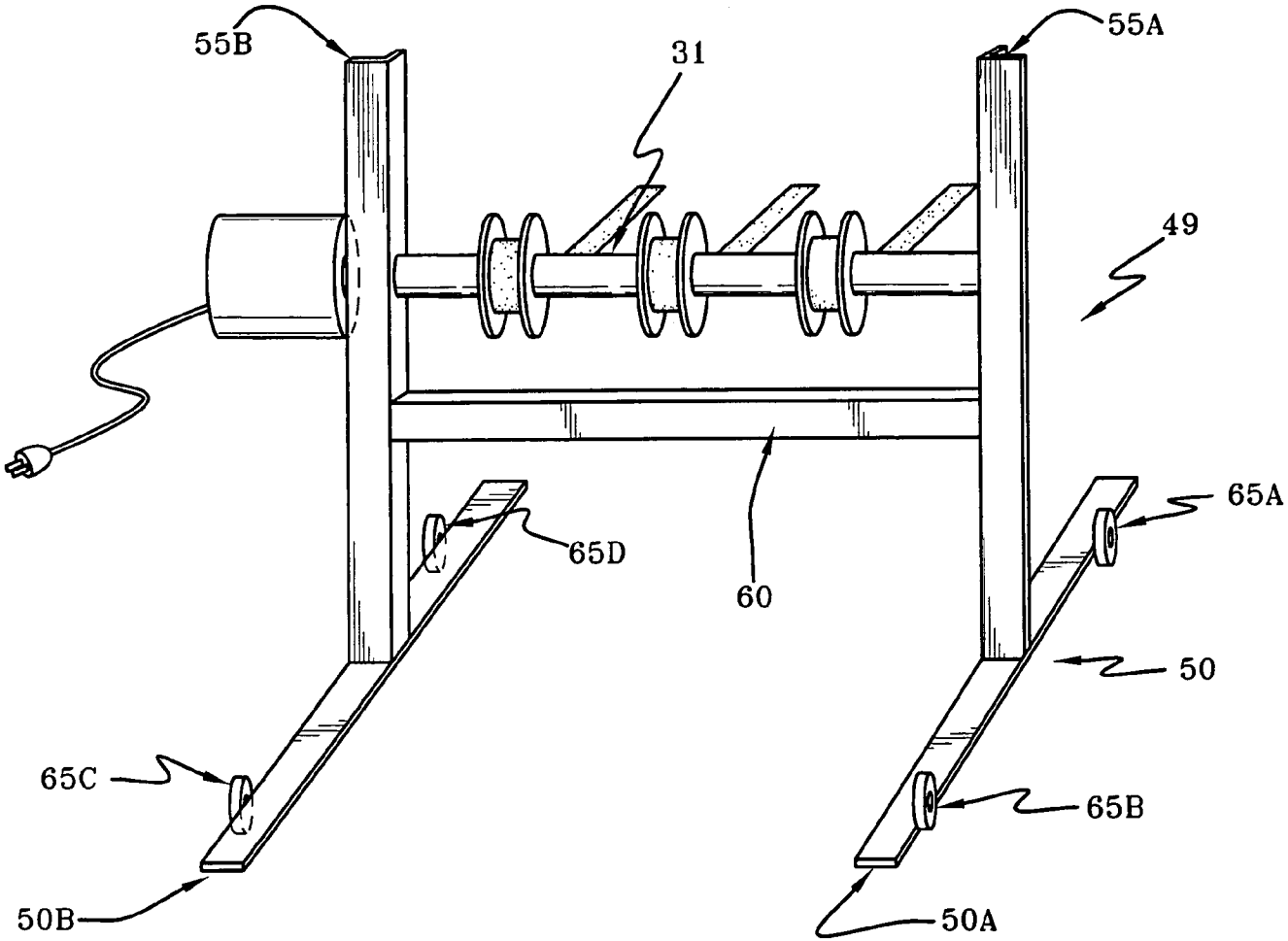
FIG. 2 is a plain view of the portable device showing the components of the device with a portable frame.

With reference now to FIG. 2, an alternate embodiment of the device 1 is shown, wherein the assembly discussed in the previous paragraph is received onto a selectively positionable frame, generally shown as 49. The selectively positionable frame 49 may have a base 50. In the preferred embodiment, the base 50 may be comprised of first and second base beams 50*a*, 50*b* placed in a substantially horizontal array. The first and second base beams 50*a*, 50*b*, may be constructed out of steel; however, the first and second base beams 50*a*, 50*b* may be manufactured from plastic, rubber, or any other material selected with sound engineering judgment. The base 50 may be an array of first and second beams 50*a*, 50*b*; however, it may also be a single, substantially solid element or any other shape, size or combination of elements that is selected with sound engineering judgment.

With continued reference to FIG. 2, the selectively positionable frame 49 also has first and second support members 55*a*, 55*b* that extend from the base 50. In the preferred embodiment, there may be two support members 55*a*, 55*b*, each of which extends from the base 50 in a substantially vertical direction. However, it is contemplated that there may be a single support member 55*a* or any other number of support members extending from the base 50 as may be selected with sound engineering judgment. The first and second support members 55*a*, 55*b* may be removably attached to the base 50 by mechanical fasteners or slotting means or by any other means selected with sound engineering judgment. However, it is also contemplated that the first and second support members 55*a*, 55*b* may be fixedly attached to the base 50 by mechanical fasteners, welding or by process of manufacture wherein the first and second support members 55*a*, 55*b* are integrally manufactured as a single part with the base 50 or by any other means selected with sound engineering judgment. The first and second support members 55*a*, 55*b* may be constructed of steel; however, they may also be constructed from aluminum, plastic, rubber or any other material selected with sound engineering judgment.

With continued reference to FIG. 2, the selectively positionable frame 49 may also have a first bracing member 60, extending from the first and second support member 55*a*, 55*b*. In the preferred embodiment, there is one bracing member 60, which may be a steel bar that is fixedly attached at each of its ends to one of the first and second support members 55*a*, 55*b*. The bracing member 60 may be substantially horizontal with respect to the ground; however, the bracing member 60 may extend from the first and second support members 55*a*, 55*b* at any angle selected with sound engineering judgment. It should be recognized, as noted previously concerning the first and second support members 55*a*, 55*b*, that the bracing member 60 may be attached to the first and second support members 55*a*, 55*b* by any means selected with sound engineering judgment. Additionally, the bracing means 60 may be made of any material that is selected with sound engineering judgment. It should also be noted that the bracing member 60 may be used in conjunction with a single support member 55*a*, or any other number of support members 55*a*, 55*b*. In this manner, the bracing member 60 may cantilever off a single support member 55*a* so as to carry a portion of a shaft 31 that may be included as part of the output means 30 of the prime mover 25.

With continued reference to FIG. 2, the frame 49 may be selectively positionable so that one of ordinary strength can move this embodiment of the device 1 to a position adjacent a plurality of different associated beds 5 (shown in FIG. 1). Accordingly, the total weight of the device 1 may be limited to permit one of ordinary strength to selectively move the device 1 by dragging or lifting and carrying. The device 1 may weigh fifty (50) pounds. The device 1 may weigh up to one hundred (100) pounds or any weight that is within sound engineering judgment. It is also contemplated that the device 1 may have first, second, third and fourth rolling means 65*a–d* coupled to the selectively positionable frame 49 to assist an associated user in moving the device 1 to a position adjacent an associated bed 5 (shown in FIG. 1). In the preferred embodiment, the rolling means 65*a–d* are four caster wheels that are affixed to the base 50; however, it is contemplated that the rolling means 65*a–d* could be ball bearings, skids, pneumatic tires or any other means selected with sound engineering judgment.

Figure 3:
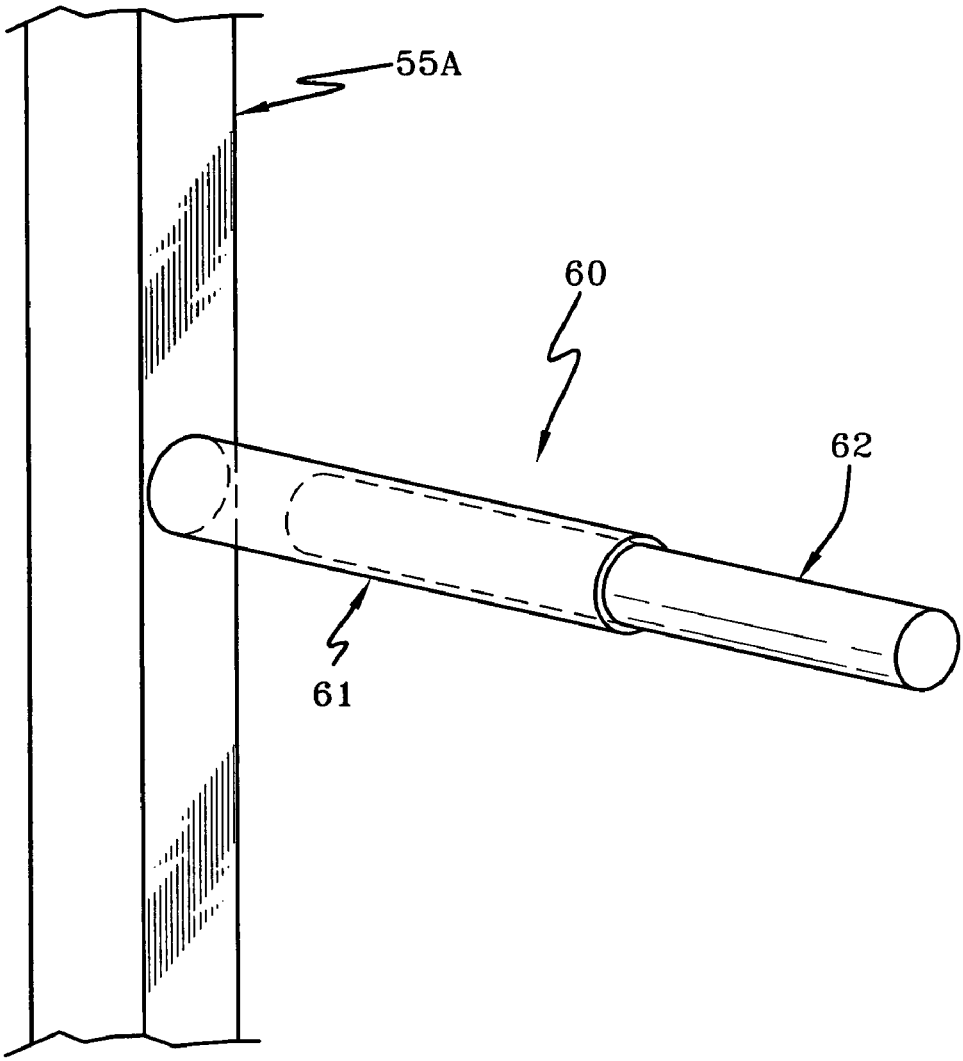
FIG. 3 is a close-up of a portion of the portable frame showing a means for adjusting a structural element of the frame.
Figure 4:
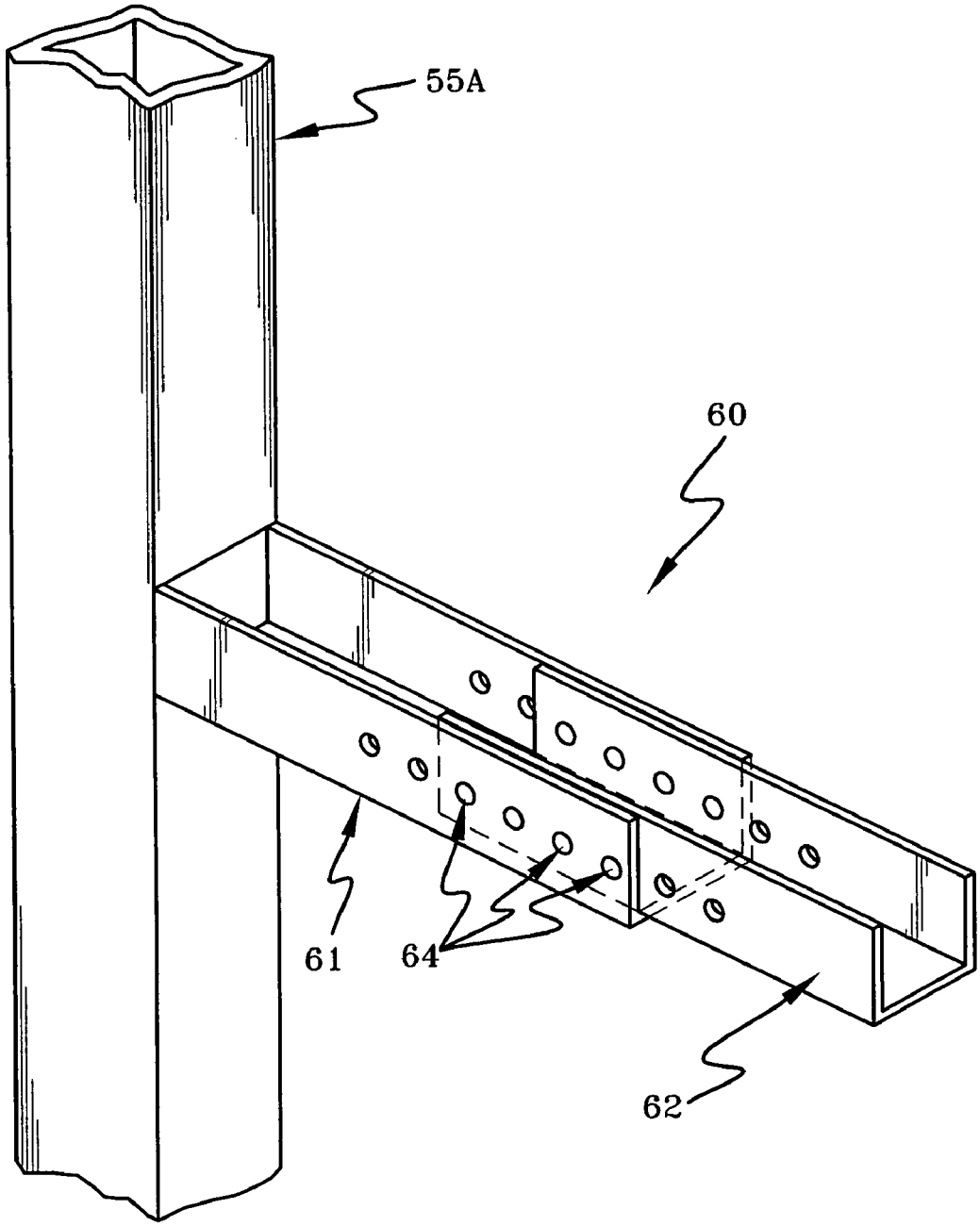
FIG. 4 is a close-up of a portion of the portable frame showing an alternate means for adjusting a structural element of the frame.

With reference to FIGS. 2, 3 and 4, it is contemplated that the selectively positionable frame 49 may be selectively adjustable so as to be usable in conjunction with a plurality of differently sized associated beds 5 (shown in FIG. 1). In this manner, the selectively positionable frame 49 may be adjustable in any of three dimensions, horizontal x, vertical y or in width z. Where the selectively positionable frame 49 is selectively horizontally adjustable, the selectively positionable frame 49 and, therefore, the device 1, may be used in conjunction with associated single width, double width, full width, queen width or king width beds 5 (shown in FIG. 1) or an associated bed 5 of any other width. Where the selectively positionable frame 49 is selectively vertically adjustable, the selectively positionable frame 49 and, therefore, the device 1, may be used in conjunction with an associated bed 5 of any height.

With reference to FIGS. 3 and 4, a bracing member 60 is shown having a first bracing portion 61 and a second bracing portion 62. The first bracing portion 61 may extend from one of the first and second support members 55*a*, 55*b*. The first bracing portion 61 may be affixed to one of the first and second support members 55*a*, 55*b* by means discussed herein, or by any means selected with sound engineering judgment. The second bracing portion 62 may be selectively, extendably coupled to the first bracing portion 61. In this manner, the length of the bracing member 60 may be selectively lengthened or shortened by adjusting the second bracing portion 62 with respect to the first bracing portion

61. In one embodiment, shown in FIG. 3, the second bracing portion 62 may telescopically extend from the first bracing portion 61. In an alternate embodiment, shown in FIG. 4, the second bracing portion 62 may be slidably coupled to the first bracing portion 61, with each of the first and second bracing portions 61, 62 having a plurality of aligning holes, shown generally at 64, that permit an associated user to selectively extend the bracing member 60 and lock the first and second bracing portions 61, 62 together as with a pin passing through the aligning holes 64. While two embodiments of selective, extendable coupling have been demonstrated in FIGS. 3 and 4, it should be noted that there are a myriad of other means for making the bracing member 60 selectively, extendable. Any means for selectively extending the bracing means 60 may be selected with sound engineering judgment. Additionally, the means for selectively extending the bracing member 60 may be incorporated into the first and second support members 55*a*, 55*b*, the first and second brace members 50*a*, 50*b*, the shaft 31 that may be included as part of the first output 30 or any other component of the device 1 that may be selectively extendable with sound engineering judgment. In this way, the selectively positionable frame 49 and the device 1 may be adjusted in any direction for use in conjunction with an associated bed 5 of any size.

In a manner consistent with the aforementioned, the selectionably positionable frame 49 may be juxtaposed adjacent a first associated bed. The strap members 15, 16 may be selectively fastened to the associated bed sheet in a manner consistent with that previously described herein. Having fastened the strap members 15, 16, the device 1 may be operated, thereby translating the patient. Subsequently, the selectively positionable frame 49 may be selectively detached and repositioned adjacent a second associated bed for use in translating a second associated patient. Herein, the device 1 may be repositioned and used to translate a plurality of associated patients in this manner.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A device for longitudinally translating an associated individual along an associated bed having an associated frame and an associated bed sheet, the device comprising:

at least a first strap member having first and second ends, wherein the at least a first strap member is operatively coupled to the associated bed sheet at the first end of the at least a first strap member;

at least a first pulley rotatably attached with respect to the associated bed frame, wherein the second end of the at least a first strap member is windably communicated with the at least a first pulley;

a prime mover having at least a first output, wherein the at least a first output is operatively coupled to the at least a first pulley, wherein when the prime mover is engaged said first output is rotated in a first output direction and the at least a first pulley is rotated in a first pulley direction windably drawing the at least a first strap member around the at least a first pulley; and, safety means for use in restricting the angular translation of the at least a first output, wherein the safety means is a switch operatively communicated to the prime mover for use in restricting drive power to actuate the prime mover; and wherein said switch is a control switch operatively communicated to control the electric motor, wherein an associated user can selectively restrict the angular translation of the at least a first output by activating the control switch.

2. A device for longitudinally translating an associated individual along an associated bed having an associated frame and an associated bed sheet, the device comprising:

at least a first strap member having first and second ends, wherein the at least a first strap member is operatively coupled to the associated bed sheet at the first end of the at least a first strap member;

at least a first pulley rotatably attached with respect to the associated bed frame, wherein the second end of the at least a first strap member is windably communicated with the at least a first pulley;

a prime mover having at least a first output, wherein the at least a first output is operatively coupled to the at least a first pulley, wherein when the prime mover is engaged said first output is rotated in a first output direction and the at least a first pulley is rotated in a first pulley direction windably drawing the at least a first strap member around the at least a first pulley; and, safety means for use in restricting the angular translation of the at least a first output, wherein the safety means is a switch operatively communicated to the prime mover for use in restricting drive power to actuate the prime mover, wherein the switch is selectively adjustable for use in adjusting the speed of the at least a first output.

3. The device of claim 2 wherein the switch is a remote control switch.

* * * * *